US008296892B2

(12) United States Patent
Del Rosso

(10) Patent No.: US 8,296,892 B2
(45) Date of Patent: Oct. 30, 2012

(54) INSIDE BOAT THRUHOLE FITTING CLEARING

(76) Inventor: Edward J. Del Rosso, Matawan, NJ (US)

( * ) Notice: Subject to any disclaimer, the term of this patent is extended or adjusted under 35 U.S.C. 154(b) by 475 days.

(21) Appl. No.: 12/589,987

(22) Filed: Nov. 2, 2009

(65) Prior Publication Data

US 2011/0099733 A1 May 5, 2011

(51) Int. Cl.
*B08B 9/00* (2006.01)

(52) U.S. Cl. ..... 15/104.03; 15/104.05; 137/242; 137/244; 137/245.5

(58) Field of Classification Search ..... 15/104.03, 15/104.05, 104.16; 137/242, 244, 245.5
See application file for complete search history.

(56) References Cited

U.S. PATENT DOCUMENTS 2,147,593 A * 2/1939 Bracken ..... 134/168 C
2,253,888 A * 8/1941 Carlson ..... 137/238
3,460,857 A * 8/1969 Larkin ..... 285/98
4,898,201 A * 2/1990 Conley et al. ..... 137/245.5
5,035,796 A * 7/1991 Saylor et al. ..... 210/198.1
5,879,033 A * 3/1999 Hansel et al. ..... 285/239
6,039,320 A * 3/2000 MacDonald ..... 277/370
6,206,021 B1 * 3/2001 Hartman et al. ..... 137/15.06
6,772,918 B2 * 8/2004 Mack, Jr. ..... 222/472
6,813,797 B1 * 11/2004 Kadinger ..... 15/104.04
7,506,395 B2 * 3/2009 Eldridge ..... 15/104.05
2006/0085930 A1 * 4/2006 Eldridge ..... 15/104.03

* cited by examiner

*Primary Examiner* — Mark Spisich
*Assistant Examiner* — Michael Jennings
(74) *Attorney, Agent, or Firm* — Charles I. Bradsky

(57) ABSTRACT

A kit for cleaning clogged conduits and thruhole fitting valves in water intake systems of pleasure boats, fishing boats and yacht marine craft includes a hollow, substantially cylindrical male hose coupler connected to a nipple or elbow joined with the valve, and an open-end cap having a flexible, resilient press-fitted inner gasket configured with a central orifice to receive a shaft of larger diameter able to be force-fitted through the cap, the coupler and the valve when opened, and of a strength sufficient to force-free any matter clogging the input hose to the valve from acceptable performance usage.

18 Claims, 12 Drawing Sheets

INSIDE BOAT THRUHOLE FITTING CLEARING

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

Not Applicable

BACKGROUND OF THE INVENTION

1. Field of the Invention

This invention relates to pleasure boat, fishing boat and yacht marine craft, in general, and to onboard systems employed for cooling their engines and for operating their onboard toilets and refrigerators, in particular.

2. Description of the Related Art

As will be understood, rivers, large lakes and open waters where these craft may travel typically contain natural weed growth, algae, leaves and like accumulations—as well as unnatural debris such as plastic bags, cloth rags, paper products, etc. Although attempts are taken to prevent the entry of all these materials into the intake conduits of the craft to prevent them from fouling pumps and filters, oftentimes, the thruhole fittings become clogged. On such occasions, it is not unusual for an occupant of the vessel to enter the water himself/herself to try to unclog the water intake conduit by hand. When no one on the craft is willing to enter the water where, for example, extensive weed growth is present, the solution is to call for a tow to bring the craft to a service area where an experienced technician would attempt to clear the fitting. On the other hand, where the clogging takes place while the craft is in the bay or on the sea, almost no one is ever willing to go into the very deep water to try to clear the fitting from below; there, the call for assistance is almost always made. This is especially the situation where the water intake conduit becomes clogged by barnacles which grow inside the conduit.

In all these situations of clogging, depending on the conditions, the marine engine shuts off, the onboard toilet does not flush or the refrigerator stops working. In each instance, it becomes necessary to manually clear the intake conduit, and from outside the craft.

OBJECTS OF THE INVENTION

It is an object of the present invention, therefore, to provide a new and improved manner of clearing a clogged thruhole fitting regardless of the cause of its blockage.

It is an object of the present invention, also, to provide apparatus to enable the clearing to be accomplished from inside the craft, without having to enter the water.

It is an object of the present invention, furthermore, to provide an apparatus to enable the clearing to take place in substantially the same manner, utilizing the same type of operation, for a variety of water intake conduits, realizing that some of the conduits may be of different diameters to satisfy a variety of onboard uses on the craft.

It is an object of the present invention, additionally, to allow these clearings of clogged intake conduits to be had without any need for retrofitting an existing craft design—as would be needed in those manufactures, for example, which recommend the use of a compressed air utilization to clear clogged filters employed to prevent coarse material entry to begin with.

As will be appreciated, satisfying these objectives enables the marine craft to continue on its way, without the need for any occupant entering the water, without any need for seeking assistance to tow the craft to a staging area for service to be addressed, and without any need for redesigning or altering the existing craft structure.

SUMMARY OF THE INVENTION

As will become clear from the following description, the present invention attains all these objectives through the use of a male hose coupler, having an open-end cap with an inner gasket having central orifice of predescribed diameter through which a shaft is force-fitted to extend beyond the thruhole fitting valve into the water, yet with the gasket being flexible and resilient to accept manual rotation of the shaft through the orifice and about the gasket by way of an included handle in substantially 360° rotation to force-free the valve of any clogging material. As will be described, the hose coupler joins with the nipple or elbow coupled to the valve, from which the hose to the pump is first disconnected from the nipple or elbow with the valve closed—the valve being once again opened when the hose coupler and shaft are in place. As will also become apparent, these objectives are satisfied with the described kit of the invention serving as a separate, stored article of repair aboard the boat or marine craft until its component parts are needed to clean the clogging of the thruhole fitting valve.

In a preferred embodiment, a hollow, substantially cylindrical male hose coupler is employed having four outwardly extending flanges of progressively smaller diameter in linear progression from the first, or, cap end to a second, opposite end in allowing the use of the invention with up to four nipple or elbow hose connections as may be present in service with different sized pumps aboard the boat or marine craft. Such male hose coupler will be seen to have external threads at the first end, to which the open-end cap secures through its construction of internal threads to receive the coupler. As will be appreciated, a one, two or three flange hose coupler could instead be employed for boats or craft where a lesser number of pump interconnections are present.

BRIEF DESCRIPTION OF THE DRAWINGS

These and other features of the present invention will be more clearly understood from a consideration of the following description, taken in connection with the accompanying drawings, in which.

DETALED PESCRIPTION OF THE INVENTION

Figure 1A:
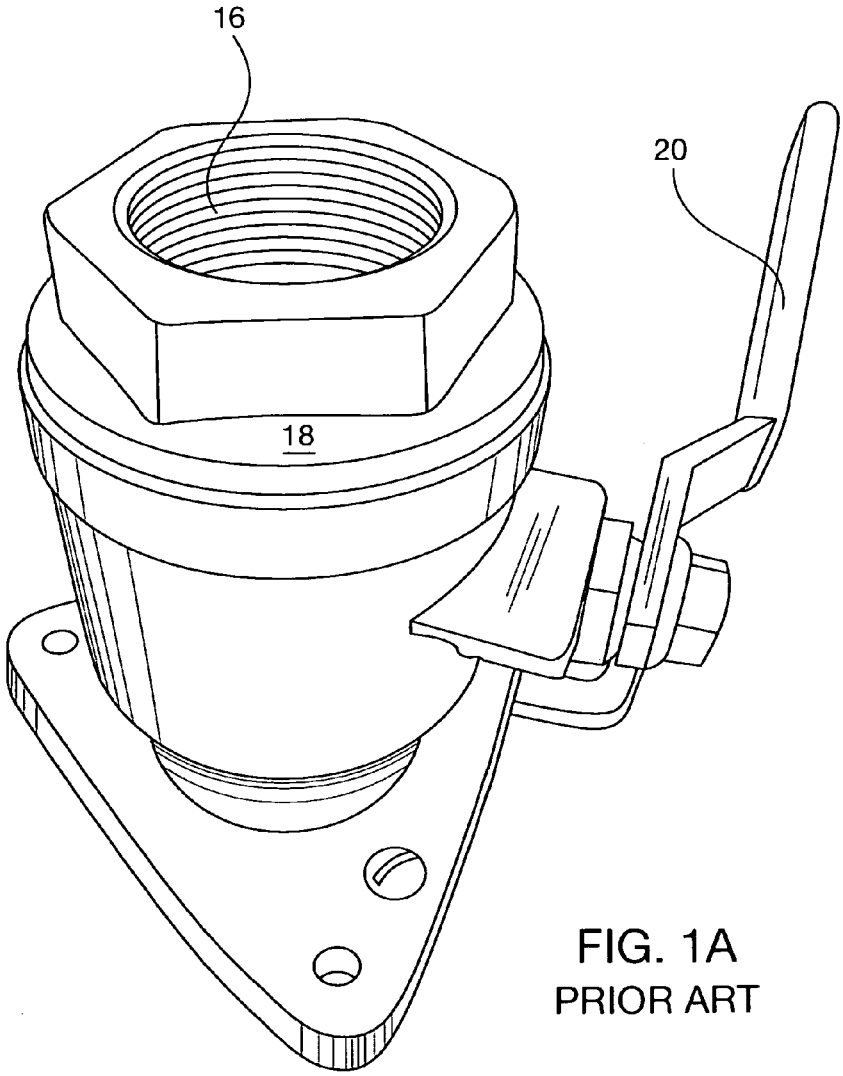
FIG. 1A PRIOR ART
FIGS. 1*a*, 1*b* and 1*c* are illustrations of typical prior art components found in water intake systems of pleasure boats, fishing boats and yacht marine craft — of a thruhole fitting valve, a nipple coupler and an elbow coupler, respectively.
Figure 1B:
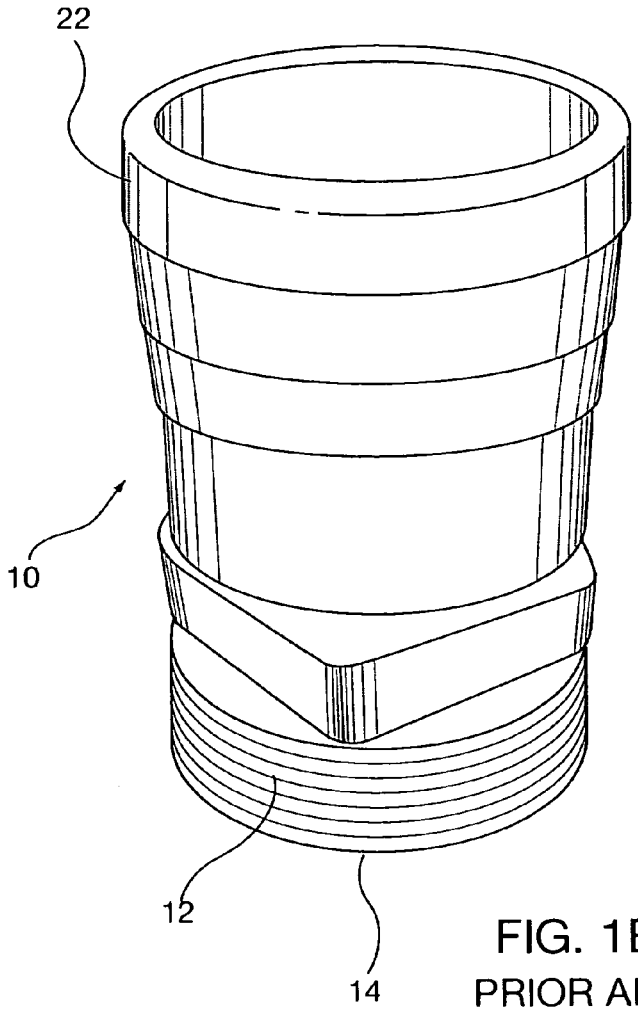
FIG. 1B PRIOR ART

The prior art nipple coupler (or "nipple") 10 of FIG. 1*b* includes external threads 12 at its lower end 14 to connect with the internal threads 16 of the prior art thruhole fitting valve 18 of FIG. 1*a*. A handle 20 serves to open the valve 18 when rotated vertically and serves to close the valve 18 when rotated to a horizontal position. In use, a plastic or rubber hose (not shown) couples over the upper end 22 of the nipple 10 to connect the valve 18 with 4 pump (not shown) to provide marine water to cool the boat or yacht's engine, or to operate the onboard toilets and refrigerators. A clamp (also not shown) typically is used to secure that hose at the upper end 22 of the nipple 10. An orifice is provided in the bottom of the valve 18 to receive another hose serving as a conduit for the river, lake or open waters to be drawn in and utilized in these manners when the valve is opened and the pump turned "on".

Figure 1C:
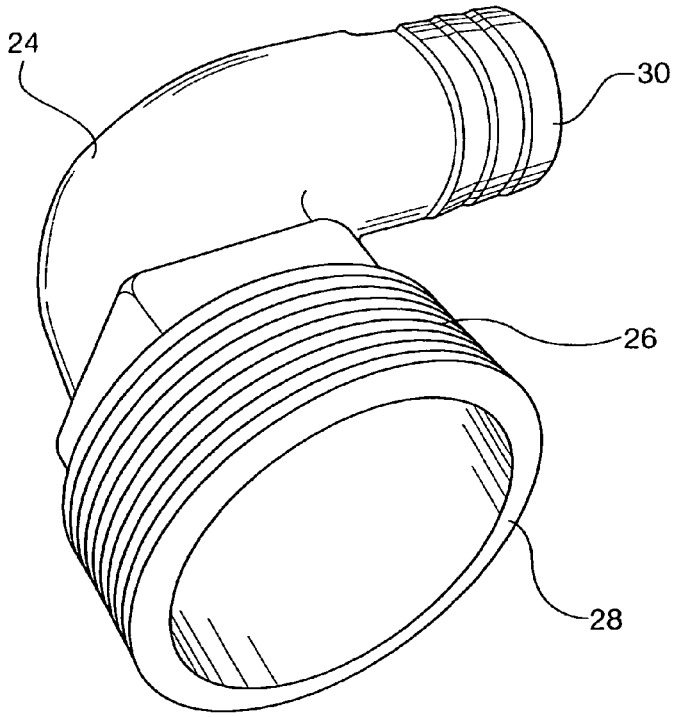
FIG. 1C PRIOR ART

In those instances where insufficient room exists on the craft to run a hose vertically from the upper end 22 of the nipple 10 to the pump, the elbow 24 of FIG. 1*c* is employed instead. There, the external threads 16 of the elbow at its one end 28 connect with the internal threads 16 of the thruhole fitting valve 18 and the hose to the pump couples over in similar manner to its right angle-bent end 30. A clamp (similarly not shown) secures the hose at the elbow end 28 in its path to the pump.

Figures 2A, 2B, 2C:
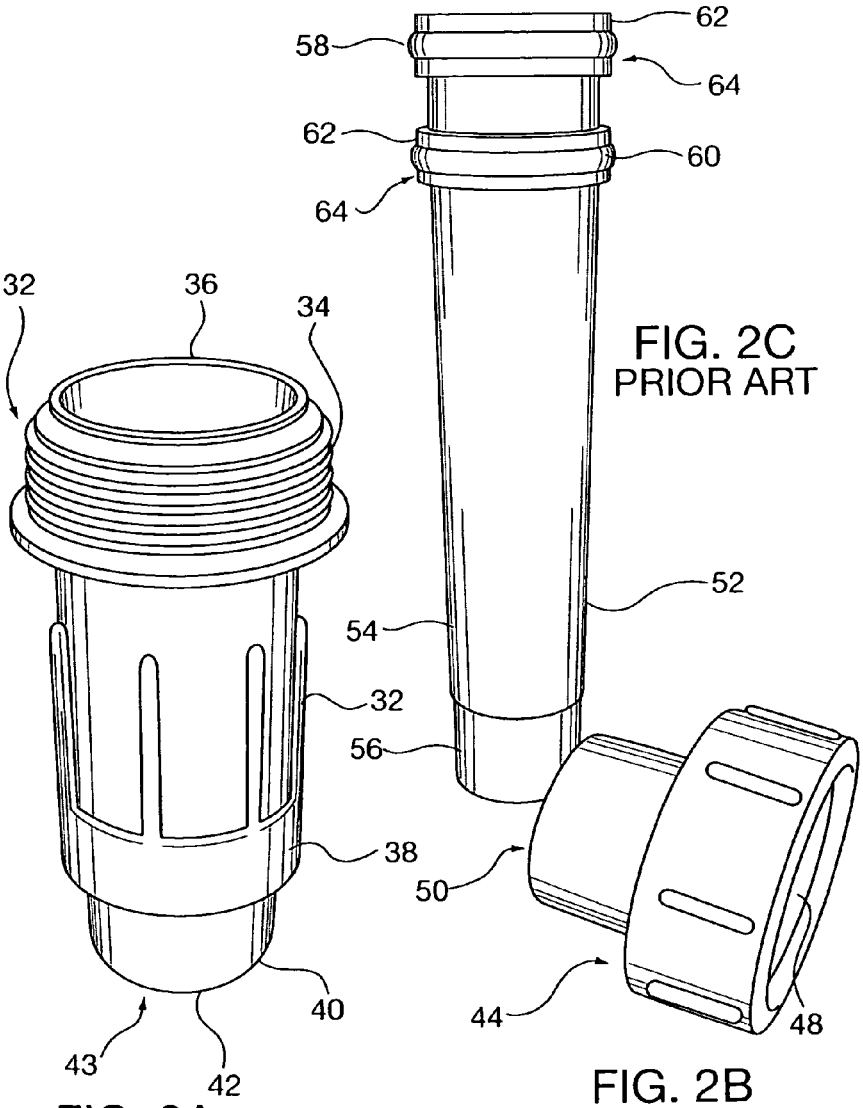
FIG. 2C PRIOR ART
FIG. 2A PRIOR ART
FIG. 2B PRIOR ART
FIGS. 2*a*, 2*b*, 2*c*, 2*d*, 2*e* and 2*f* are illustrations of component parts of a prior art male hose coupler useful in the attainment of the objectives of the present invention.

FIG. 2*a* illustrates a hollow, substantially cylindrical prior art male hose coupler 32 having external threads 34 at an upper end 36. A pair of outwardly extending flanges 38, 40 of progressively smaller diameter extend linearly from the upper end 36 of the coupler 32 to an opposite second, or lower end 42. An open end cap 44 (FIG. 2*b*) is provided with internal threads 48 to secure the bap 44 with the upper end 36 of the coupler 32. As will be appreciated, in its usage as a coupler, a first hose (not shown) is clamped about an input port 50 of the cap 44, and a further hose is clamped to either of the flanges 38 and 40 in forming a water conduit. The lower end 42 of the male hose coupler 32 then serves as its output port 43.

Figure 2D:
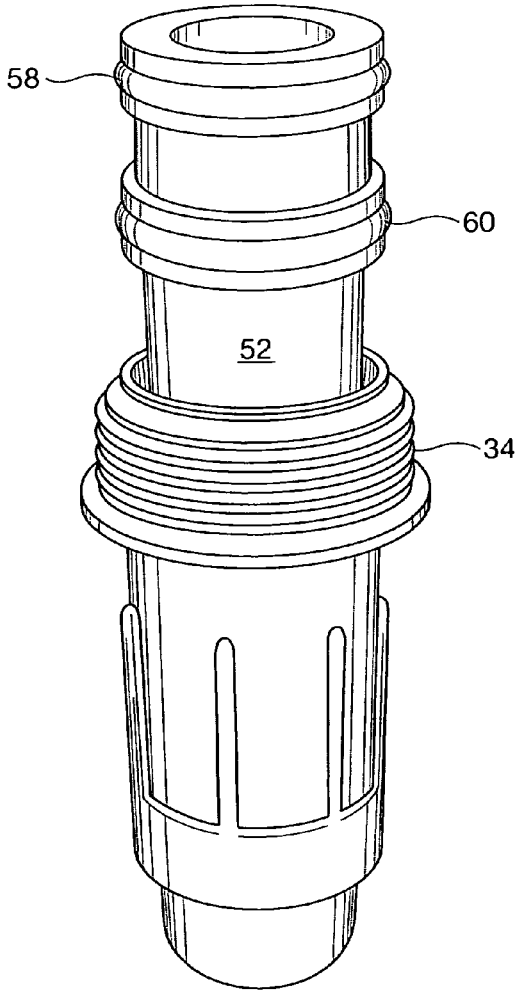
FIG. 2D PRIOR ART
Figure 2E:
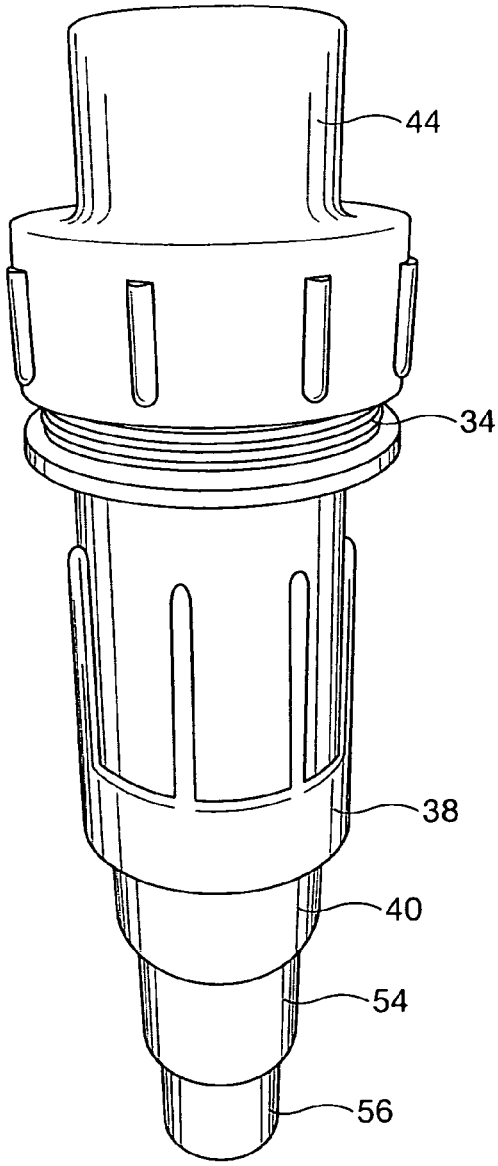
FIG. 2E PRIOR ART

Additionally; and in a typical construction, a coupler extension 52 is available for insertion at the upper end 36 of the coupler 32 to; protrude beyond the coupler's lower end 42 (FIG. 2*c*). In such manner, two additional outwardly extending flanges 54, 56 are hoses provided, as to allow the clamping of ever smaller diameter hoses on to the coupler. The extender 52 includes a pair of washers 58, 60 within walled. channels 62, 64 in providing a water sealant in the coupling which follows. FIG. 2*d* shows the coupler extension being inserted, with FIG. 2*e* showing the result with th.? full insertion and with the open-end cap 44 secured "on".

Figure 2F:
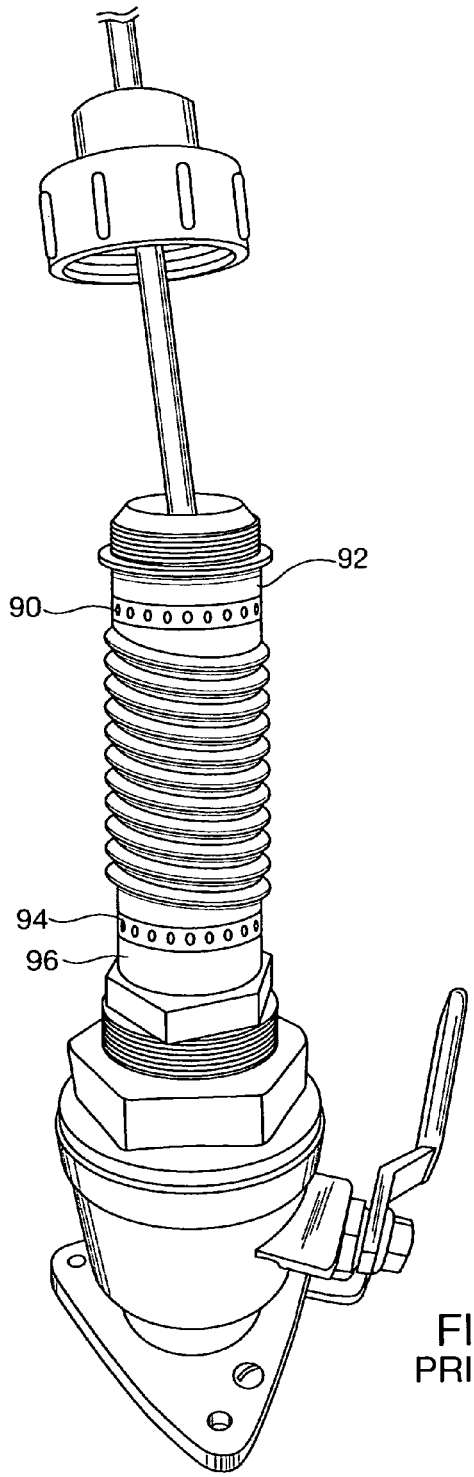
FIG. 2F PRIOR ART
Figure 6A:
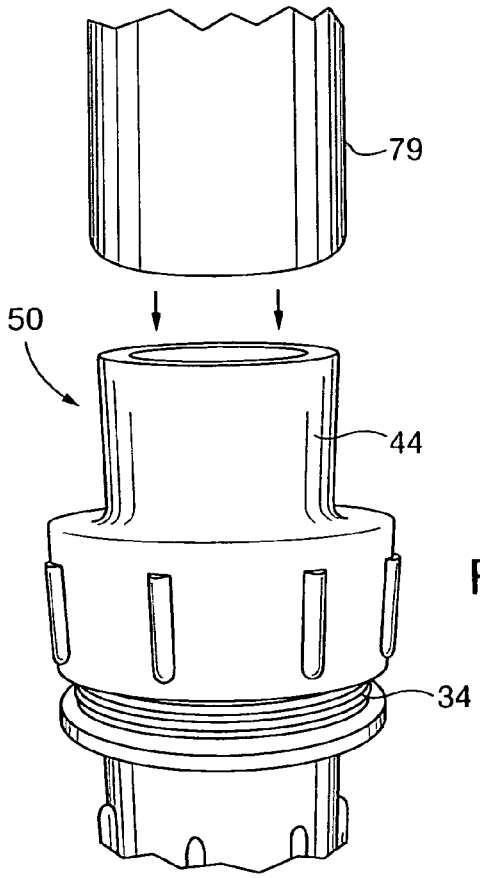
FIGS. 6*a* and 6*b* illustrates hose and clamp components Employed in carrying out the invention.
Figure 6B:
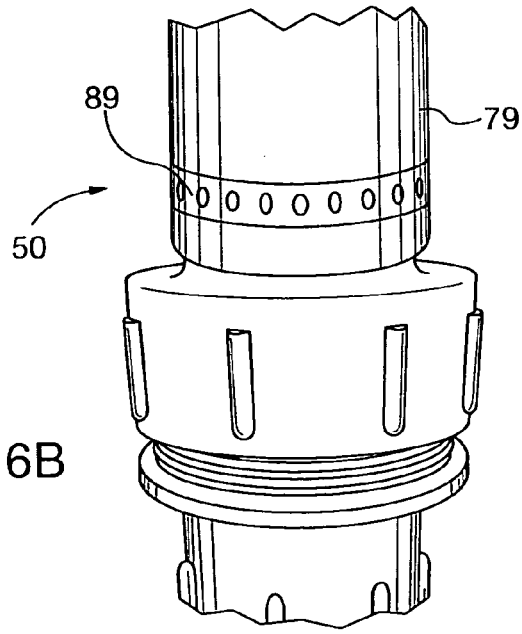

In accordance with the teachings of the present invention, a kit is provided which includes, as an example, this prior art coupler 32, the coupler extension 52 with its washers 58, 60, the open-end cap 44, and four hoses, each having an inner diameter to fit abound and over the input port 50 of the cap 44, and the others having inner diameter hoses to fit over the appropriate flange 38, 40 of the coupler 32 or of the flange 54, 56 of the extension 52. Such hoses may be of a plastic or rubber composition. A pair of clamps as in FIG. 2*f* are also included in the kit, of any appropriate construction — one (90) to be positioned near there the hose (a portion shown at 92) is to overlap a flange (as shown) and the other (94) where it is to secure to either the upper end 22 of the nipple 10 or the right angle bent end 30 bf the elbow 24 (as at 96). An example of the hose overlying the input ports 50 of the caps 44 is shown at 79 in FIG. 6*a* while an example of the clamps 89 is shown at FIG. 6*b*.

Figure 3A:
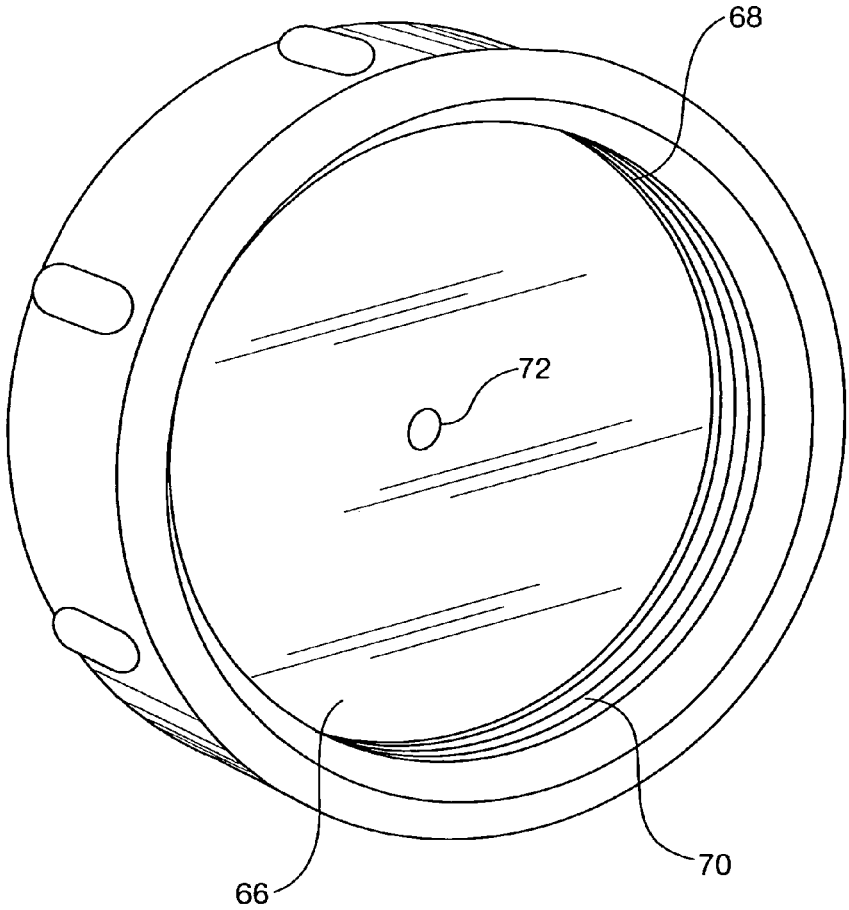
FIGS. 3*a*, 3*b*, 3*c* and 3*d* are illustrations of the shaft and gasket interrelationships helpful in understanding the teachings of the invention.

As will become clear from the following description, the kit is included within a package to be stored aboard the pleasure boat, fishing boat or yacht, awaiting time for its need in clearing the valve when it becomes clogged with natural weed growth, algae, leaf and like accumulations — as well as such unnatural debris as plastic bags, cloth, rags and paper products when traveling through rivers, large lakes and open waters. In accordance with the teachings of the present invention, the open-end cap 44 of FIG. 2*b* is modified to include a flexible gasket 66 (FIG. 3*a*) preferably of a neoprene rubber composition press-fitted within the cap between side surfaces 68, 70. Additionally, a substantially central orifice 72 is provided in the gasket 66. To finalize the construction, the kit of the inventions also includes a shaft 74 (FIG. 3*b*) of a diameter greater than that of the orifice 72 but able to be force fitted through the orifice. Such shaft 74, additionally, is of a length to extend through the open-end cap 44 through its input port 50, through the hose coupler 32, through the hose secured at its lower end 42 and through the nipple 10 or elbow 24, through the valve 18 in this manner, with the shaft being of a composition sufficiently strong to force-free the valve 18 of any matter clogging it. The shaft then becomes effective to clear whatever clogging exists in the valve 18 from inside the boat or craft, without requiring anyone to leave the vessel and enter the water. FIG. 4 illustrates schematic arrangement of how the kit of the invention can be taken from storage for use in attaining this objective. Rotating the shaft 74 will be understood to free; the clogging of the valve.

Figure 3B:
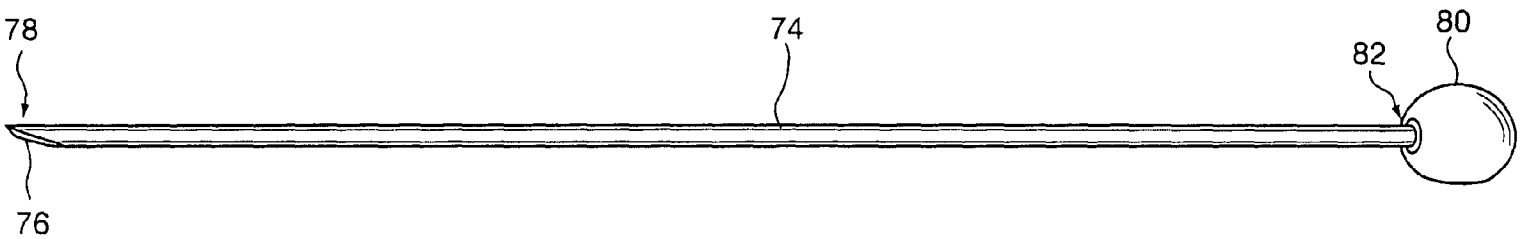
Figure 3C:
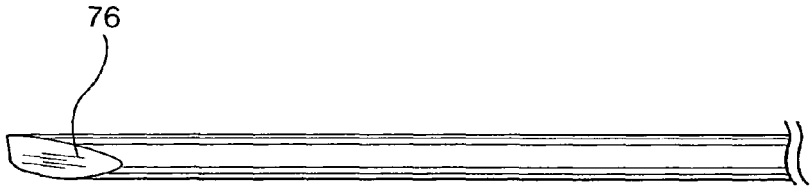
Figure 3D:
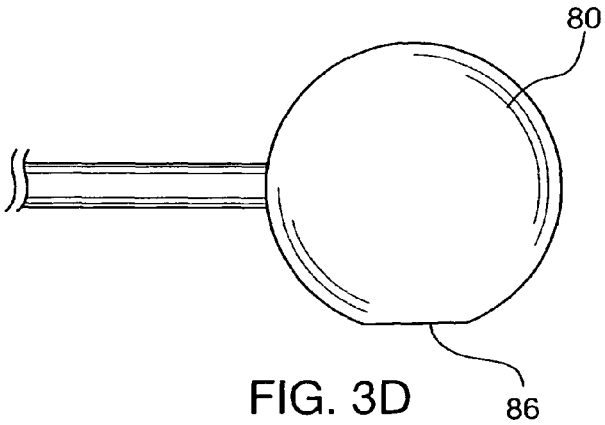
Figure 4:
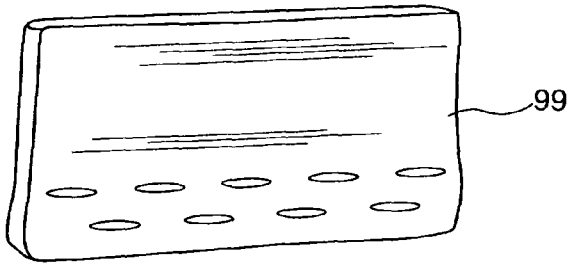
FIG. 4 illustrates a storage compartment for the component parts employed to clear a valve blockage.

As more particularly shown in FIGS. 3*b* and 3*c*, to optimize this, the shaft 74 is provided with a slanted groove cut-out 76 at a loner end 78 and a handle 80 at an upper end 82. Such slotted cut-out 76 facilitates the use of the shaft in additionally clearing barnacles that may form in the hose coupling the marine water to the valve 18, while the handle 80 is of a substantially circular knob configuration 84 with a flat portion 86 in alignment with the cut-out 76 so as to assist a user in determining the orientation of the shaft at any time in clearing barnacles from the sides of the input hose (FIG. 3*d*). In this embodiment, the gasket 66 is selected of a resilience to accept the manual rotation of the shaft 74 in and about the orifice 72 in th4 force-freeing of the valve in a substantial 360° plane of orientation from side-to-side and front-to-back.

Figure 5:
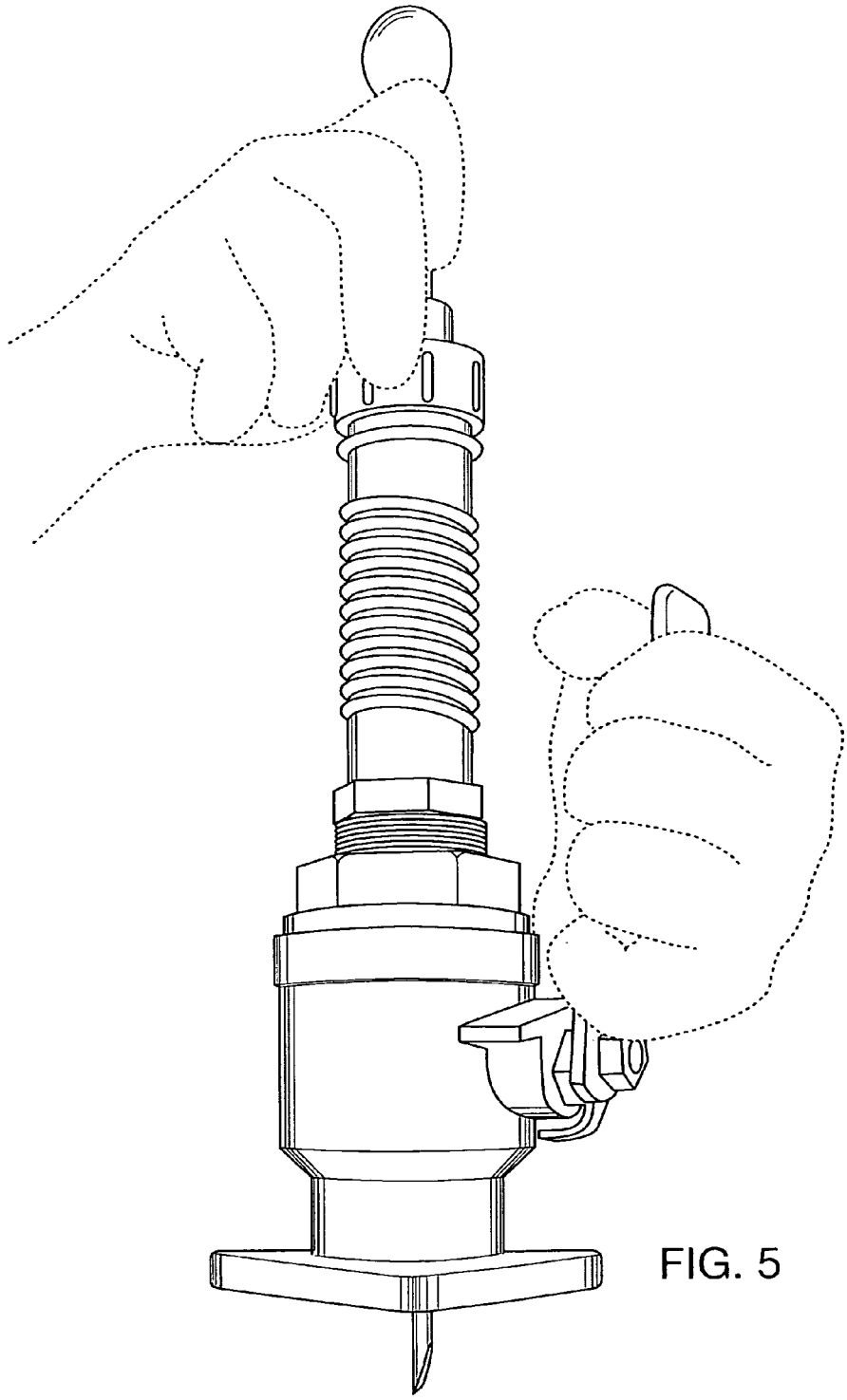
FIG. 5 illustrates a manner of assembling the component parts for use.

In use of the invention, while everything is operating normally aboard the boat or craft, the kit of the invention is included in a storage compartment 99 (FIG. 4). Once it is determined that a clog exists, the hose connected to the engine, toilet, refrigerator, etc. is released from the upper end 22 of the nipple or from the right-angle tend end 30 of the elbow where it is connected. The components of the kit are then set up for assembly, as shown in FIG. 5, one of the provided hoses is fitted and secured over the appropriate flange 38, 40, 54 or 56 depending upon the diameter of the nipple end 22 or elbow end 30, and then clamped into securement. The shaft 74 is then force-fit through the gasket orifice 72 and the handle 80 grasped, pushed aired rotated in a circular plane through the coupler, the extension and through the valve to clear whatever clogging is present. As will be appreciated by those skilled in the art, however, before disconnecting the pump hose from the nipple or elbow, and connecting the assembled components of the invention, the handle 20 of the thruhole fitting valve 18 is first rotated to the horizontal position to close the valve — and once everything is in place for the shaft 74 to be inserted, the handle 20 is rotated to the vertical position for opening the valve 18 so the shaft can be pushed through the valve 18 to clear the blockage. Once it is determined that the clogging has been cleared, the!shaft can be withdrawn, the valve 18 closed by rotating the handle 20 back to its horizontal position, the coupler 32, and its connecting hose removed from the nipple or elbow, and the hose from the pump then reconnected. The component parts Of the kit are then broken down for placement back into the compartment 90 for use at a later time, when needed again.

While there has been described What is considered to be a preferred embodiment of the present invention, it will be readily appreciated by those skilled in the art that modifications can be made without departing from the scope of the teachings herein. Thus, for example, where a preferred embodiment may employ a pair of clamps at each end of the provided hose in securing the coupler to the nipple or elbow, the teachings of the invention would apply where only one such hose clamp is utilized. Similarly, while the use of the coupler extension 52 facilitates use of the invention for four different sized nipples or elbows, the operation of the invention will be seen to follow equally as well where the coupler extension 52 is not needed, and only nipples or elbows of two diameter selections are involved. In such instance, the kit of the invention need ably include two, instead of four, provided hoses. For at least such reasons, therefore, resort should be had to the claims appended hereto for a true understanding of the scope of the invention.

I claim:

1. A kit for clearing clogged thruhole fitting valve systems in the water intakes of pleasure boats, fishing boats and yacht marine craft employing a nipple or elbow connection in a water conduit leading from a source of marine water via a hose to a pump aboard the boat or craft comprising:

a hose of inside diameter greater than an outer diameter of the nipple or elbow coupled to the hose connection to the pump;

a hollow, substantially cylindrical male hose coupler having external threads at a first end and having two or more outwardly extending flanges of progressively smaller diameter in linear progression from said first end to an opposite second end;

a clamp to secure said hose to one of said outwardly extending flanges;

an open-end cap with internal threads to receive said first end of said coupler;

a flexible gasket press-fitted within said cap between side surfaces thereof, and having a substantially central orifice of given diameter; and a shaft of diameter greater than that of said orifice but able to force fit therethrough, said shaft being of a length to extend through said open-end cap, said hose coupler, said hose and through said nipple or elbow beyond said thruhole fitting valve when opened; and with said shaft being of a strength sufficient to force-free any intake conduit hose connected to said valve of clogging material therein.

2. The kit of claim 1 wherein said gasket is of a resilience to accept manual rotation of said shaft in and about said orifice in force-freeing of said intake conduit hose and said valve in substantially a 360° plane of rotation.

3. The kit of claim 2 wherein said shaft includes a slanted groove cut-out at a lower end and a handle at an upper end.

4. The kit of claim 2 wherein said shaft includes a slanted groove cut-out at a lower end and a substantially circular knob handle at an upper end having a flat portion in alignment with the groove cut-out at said lower end.

5. The kit of claim 2 wherein said gasket is of a neoprene rubber composition.

6. The kit of claim 2, also including a storage package for said hose, said hose coupler, said clamp, said open-end cap, said flexible gasket, and said shaft.

7. A kit for clearing clogged thruhole fitting valve systems in water intakes of pleasure boats, fishing boats and yacht marine craft employing a nipple or elbow hose connection in a water conduit leading from a source of marine water to a pump aboard the boat or craft comprising:

a plurality of hoses, each of inside diameter greater than an outer diameter of the nipple or elbow coupled to the hose connection to the pump;

a hollow, substantially cylindrical male hose coupler having external threads at a first end and having two or more outwardly extending flanges of progressively smaller diameter in linear progression from said first end to an opposite second end;

a pair of clamps to secure a selected hose to one of said outwardly extending flanges;

an open-end cap with internal threads to receive said first end of said coupler;

a flexible gasket press-fitted within said cap between side surfaces thereof, and having a substantially central orifice of given diameter; and a shaft of diameter greater than that of said orifice but able to force fit therethrough, said shaft being of a length to extend through said open-end cap, said hose coupler, said selected hose and through said nipple or elbow beyond said thruhole fitting valve when opened; and with said shaft being of a strength sufficient to force-free any intake conduit hose connected to said valve of clogging material therein.

8. The kit of claim 7 wherein said gasket is of a resilience to accept manual rotation of said shaft in and about said orifice in force-freeing of said intake conduit hose and said valve in substantially a 360° plane of rotation.

9. The kit of claim 8 wherein said shaft includes a slanted groove cut-out at a lower end and a handle at an upper end.

10. The kit of claim 8 wherein said shaft includes a slanted groove cut-out at a lower end and a substantially circular knob handle at an upper end having a flat portion in alignment with the groove cut-out at said lower end.

11. The kit of claim 8 wherein said gasket is of a neoprene rubber composition.

12. The kit of claim 8, also including a storage package for said plurality of hoses, said hose coupler, said pair of clamps, said open-end cap, said flexible gasket, and said shaft.

13. A kit for clearing clogged thruhole fitting valve systems in water intakes of pleasure boats, fishing boats and yacht marine craft employing a nipple or elbow hose connection in a water conduit leading from a source of marine water to a pump aboard the boat or craft comprising:

four hoses, each of inside diameter greater than an outer diameter of the nipple or elbow coupled to the hose connection to the pump;

a hollow, substantially cylindrical male hose coupler having external threads at a first end and having four outwardly extending flanges of progressively smaller diameter in linear progression from said first end to an opposite second end;

a pair of clamps to secure a selected hose to one of said outwardly extending flanges;

an open-end cap with internal threads to receive said first end of said coupler;

a flexible gasket press-fitted within said cap between side surfaces thereof, and having a substantially central orifice of given diameter; and a shaft of diameter greater than that of said orifice but able to force fit therethrough, said shaft being of a length to extend through said open-end cap, said hose coupler, said selected hose and through said nipple or elbow beyond said thruhole fitting valve when opened; and with said shaft being of a strength sufficient to force-free any intake conduit hose connected to said valve of clogging material therein.

14. The kit of claim 13 wherein said gasket is of a resilience to accept manual rotation of said shaft in and about said orifice in force-freeing of said intake conduit hose and said valve in substantially a 360° plane of rotation.

15. The kit of claim 14 wherein said shaft includes a slanted groove cut-out at a lower end and a handle at an upper end.

16. The kit of claim 14 wherein said shaft includes a slanted groove cut-out at a lower end and a substantially circular knob handle at an upper end having a flat portion in alignment with the groove cut-out at said lower end.

17. The kit of claim 14 wherein said gasket is of a neoprene rubber composition.

18. The kit of claim 14, also including a storage package for said four hoses, said hose coupler, said two clamps, said open-end cap, said flexible gasket, and said shaft.

* * * * *